United States Patent [19]

Nilsson

[11] Patent Number: 4,961,682

[45] Date of Patent: Oct. 9, 1990

[54] DEVICE FOR PREVENTING DAMAGE TO SHOCK SUSCEPTIBLE PRODUCTS

[76] Inventor: Hans E. G. Nilsson, Skravelsjö 21096, UmeÅ , Sweden, S-905 90

[21] Appl. No.: 247,527

[22] Filed: Sep. 22, 1988

[30] Foreign Application Priority Data

Oct. 6, 1987 [SE] Sweden ..... 8703843

[51] Int. Cl.[5] ..... B66F 9/18

[52] U.S. Cl. ..... 414/620; 294/64.1; 414/627

[58] Field of Search ..... 414/626, 627, 642, 620, 414/911; 294/64.1, 65

[56] References Cited

U.S. PATENT DOCUMENTS

| | | | |
|---|---|---|---|
| 3,207,348 | 9/1965 | Olson | 414/627 |
| 3,260,392 | 7/1966 | Harris | 294/65 |
| 3,367,705 | 2/1968 | Ames | 414/627 X |
| 3,376,061 | 4/1968 | Harris et al. | 414/627 X |
| 4,516,905 | 5/1985 | Cavin et al. | 414/621 X |
| 4,640,661 | 2/1987 | Rasmussen | 414/627 X |

*Primary Examiner*—H. Grant Skaggs
*Assistant Examiner*—Cheryl L. Gastineau
*Attorney, Agent, or Firm*—Bacon & Thomas

[57] ABSTRACT

A device is adapted for preventing damage on products (4), preferably paper-rolls, which should not be bumped into when fetched and/or delivered by a transport vehicle (1) having a hoisting unit (2) with a transfer device (3) which is moveable relative to said hoisting unit such that it is relocated and adapted to the product when pressed thereagainst by the transport vehicle, whereby the product preferably may be sucked onto a suction device forming part of the transfer device. In order to prevent damage to the edges of the product when it is fetched or delivered, the device includes a locking device (8) which, after that the transfer device (3) has adapted to the product and said product preferably is sucked onto the suction device, locks the transfer device relative to the hoisting unit (2) in order to prevent forward tilting of the transfer device and the product thereon when said product is lifted and/or transported and/or delivered.

6 Claims, 3 Drawing Sheets

Fig. 3
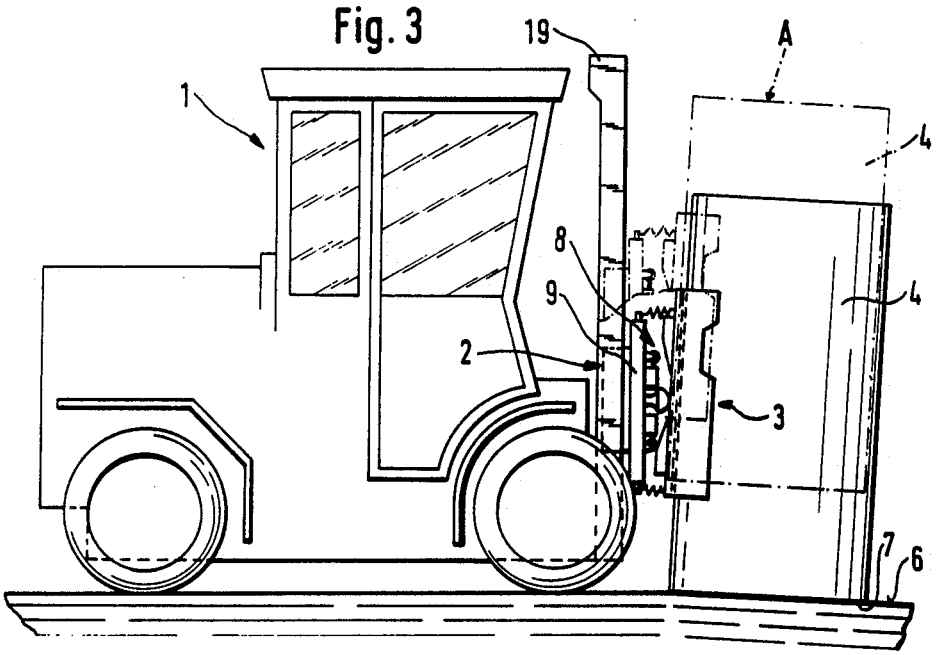
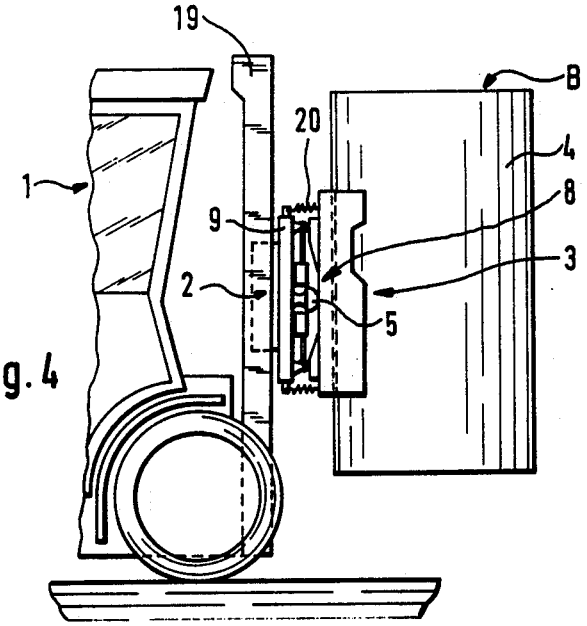
Fig. 4

DEVICE FOR PREVENTING DAMAGE TO SHOCK SUSCEPTIBLE PRODUCTS

BACKGROUND OF THE INVENTION

1. Field of the Invention

The present invention relates to a device for preventing damage to shock susceptible products, preferably paper-rolls, which are subject to damage when fetched and/or delivered by means of a transport vehicle having a hoisting unit with a transfer device which is movable relative to said hoisting unit such that it is relocated and adapted to the product when pressed thereagainst by the transport vehicle, whereby the product preferably may be sucked onto a suction device forming part of the transfer device.

2. Description of the Related Art

U.S. Pat. No. 4,516,905 shows a transport vehicle having a hoisting unit with a transfer device. The hoisting unit and transfer device cooperate through a setting unit which is adapted by compulsion to retain the transfer device relative to the hoisting unit and alter the position of the transfer device relative to the hoisting unit in order to set the transfer device in position on the product to be fetched. However, it is difficult to quickly set the transfer device such that it attains exact position relative to the product, since the driver has problems in determining when the transfer device has reached exact position relative to the product for exact connection thereto, which is necessary if the transfer device includes a suction device for grasping the product. If the suction device is not correctly positioned relative to the product, the product can not be sucked onto said suction device.

The device shown in U.S. Pat. No. 3,207,348 obviates this problem, since the transfer device is not constrained to the hoisting unit but "hangs loose" in such a manner that it automatically adapts to the position of the product when pressed thereagainst by the transport vehicle. This is a decisive advantage, since it is substantially easier and quicker to fetch and deliver the product. A problem of the prior art device however, is that the transfer device tilts forwardly when the product is lifted. This tilting movement may cause damage on the edges of the product during lifting thereof and if the product is a large paper roll, such damage can cause substantial losses because the damaged paper must be rejected. Furthermore, a product hanging forward on the hoisting unit may be damaged when putting it down after transportation.

According to the '348 patent, one has tried to eliminate this problem by tipping the mast on the transport vehicle backwards, but this involves a coarse setting that is difficult to determine, and which also may cause loading of the edges of the product during lifting or delivering thereof.

SUMMARY OF THE INVENTION

The object of the present invention is to eliminate the abovementioned problems and prevent, at hoisting units with "loosely hanging" transfer devices, the product from tilting forwards during lifting, whereby the product may be handled without the risk of loading or damaging the edges. This object is achieved according to the invention by means of the characterizing features of claim 1.

While the locking device of the invention can "freeze" the movement of the transfer device relative to the hoisting unit after said hoisting unit is adapted to the product for lifting thereof, the product may be lifted by means of the hoisting unit without the risk of the product tilting forwards.

BRIEF DESCRIPTION OF THE DRAWINGS

The invention will be further described below with reference to the accompanying drawings, in which FIGS. 1–4 illustrate the function of the device according to the invention during a lifting moment;

DETAILED DESCRIPTION OF THE PREFERRED EMBODIMENT

Figure 1:
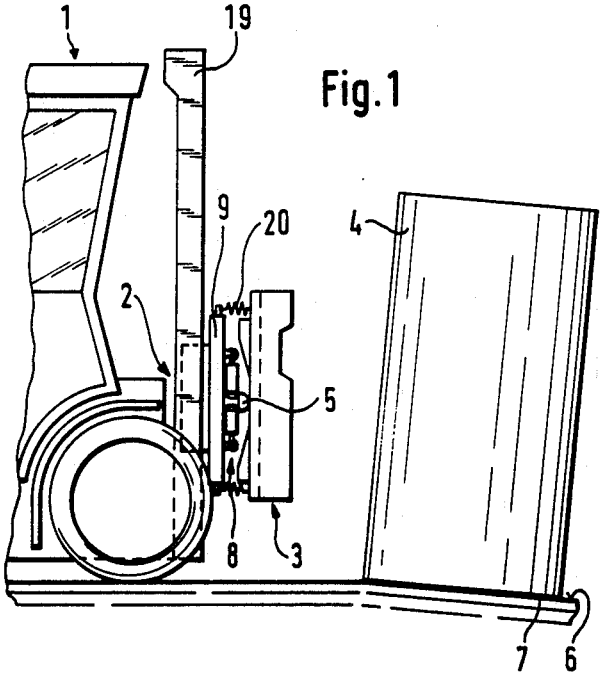
Figure 2:
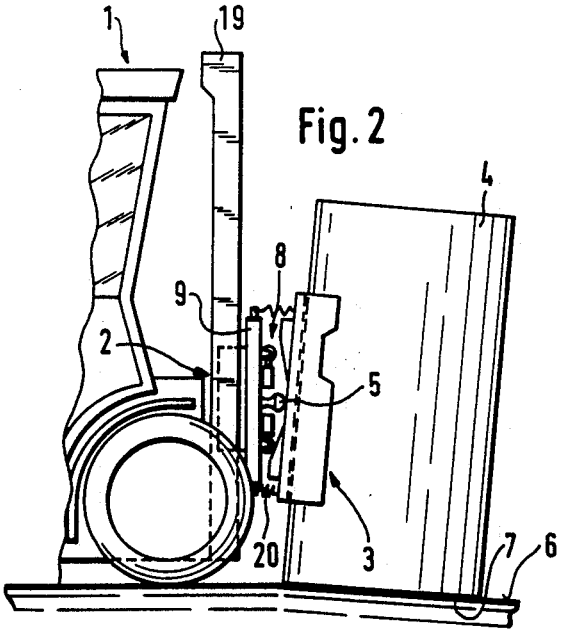

The device according to the invention is thus adapted to prevent damages on such products, preferably paper rolls, which must be handled carefully when fetched and/or delivered by means of a transport vehicle. The transport vehicle, e.g. a truck, includes a hoisting gear 2 with a transfer device 3 in order to permit connection to the product 4. The shock susceptible product 4 is preferably a paper roll and the transfer device 3 preferably comprises a suction device (not shown) adapted to be connected to the product such that said product is fixed by vacuum. In order to permit optimum connection to the product 4 for efficient suction, the transfer device 3 is moveable in all directions relative to the hoisting unit 2, e.g. through a ball joint 5. FIGS. 1 and 2 illustrate when the transport vehicle 1 approaches the product 4, a paper roll, which for the purpose of illustration, is provided standing upright on an inclined surface 6. The transfer device 3 is "loosely" disposed on the hoisting unit 2 in the sense that it automatically adapts its position to the position of the paper roll 4 when the transport vehicle 1 presses said transfer device against said paper roll. It is thus guaranteed that the suction device will sealingly engage the paper roll 4 when the product is subject to vacuum pressure.

In the prior art, if the product 4 is lifted in this position by means of the hoisting unit 2, it would, because of the movability of the transfer device 3, tilt forwards due to its weight and at least the edge portion 7 thereto would slide against the ground 6 and become damaged. It is obvious that this occurs also if the product 4 stands on a horizontal and/or even ground.

The device according to the invention however, includes a locking device 8 adapted to lock the movement of the transfer device 3 relative to the hoisting unit 2 after connection of said transfer device to the product, whereby forward tilting of the transfer device 3 and thus of the product relative to the hoisting unit 2 is prevented during lifting as well as during transport and delivery of the product (see FIG. 3). The locking device 8 may be mounted separately on either the hoisting unit 2 or the transfer device 3 and made to cooperate with the transfer device and hoisting unit respectively. Since the transfer device 3 preferably is releasable from the hoisting unit 2 such that the transport vehicle 1 may be used also for other purposes, it is better to mount the locking device 8 on the transfer device. According to a preferred embodiment however, as is also apparent from the drawings, the locking device 8 forms part of a separate, also releasable member of the hoisting unit 2 which further includes a coupling means 9 onto which the transfer device 3 is movably journalled and which permits connection of said member to the hoisting unit 2. Thus, with this structure, the locking device 8 is adapted to lock the movement of the transfer device 3 relative to the coupling means 9, which is fixedly connected to the hoisting unit 2. With this embodiment, it is possible in a simple manner to connect the locking device 8 when required.

Figure 7:
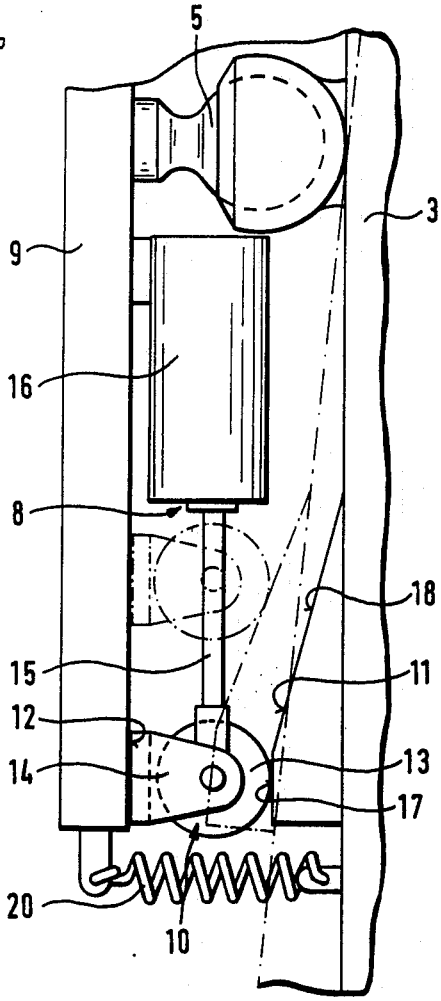
FIG. 7 is an enlarged view of a part of the device according to the invention.

The locking device 8 comprises, either as a separate part or as a part of a releasable member, at least one locking unit with preferably a movable wedge 10, which for locking the transfer device 3 relative to that part on which it is movably mounted, i.e. the hoisting unit 2 or, as in the embodiment shown, the coupling means 9, may engage a lock surface 11 on the transfer device and/or a lock surface 12 on coupling means 9. In the embodiment shown in the drawings (see especially FIG. 7), the wedge 10 is insertable between the lock surfaces 11, 12 and has a roller 13 and a support member 14, whereby the support member is adapted to engage one of the lock surfaces and ensure that the roller can roll on the other lock surface. In a suitable embodiment, the wedge 10 forms part of a moveable member of a hydraulic aggregate, which may be connected to the hydraulic system of the transport vehicle 1 such that no separate power source is required for the operation of the locking device 8. The roller 13 and support member 14 each adapted to cooperate with one of the lock surfaces 11, 12, are thereby connected to the cylinder 16 of the hydraulic aggregate via a piston rod 15. Since, in the embodiment shown, the cylinder 16 is mounted on the coupling means 9, the roller 13 cooperates with the lock surface 11 on the transfer device 3, while the support member 14, by engaging the lock surface 12 on the coupling means 9, ensures that the roller rolls on its lock surface. Alternatively, the cylinder 16 may take over the function of the support member by directly engaging the coupling means 9.

The locking function described above has anticipated a single locking position arrived at when the transfer device 3 has been connected to the product 4. Such a position can normally also be assumed directly during lifting of the product 4 from a surface not inclining relative to the surface on which the transport vehicle 1 is positioned. However, when as in FIG. 3 the product 4 is disposed on an inclined surface 6, the product must be lifted with the transfer device 3 locked in an inclined position relative to the hoisting unit 2 in order not to damage the product. If however the product 4 shall be delivered on e.g. level ground, it is necessary to alter the position of the product before deliverance. Otherwise, the product 4 will have its edges damaged at deliverance. In order to avoid damage of the edges and permit repositioning of the product 4 after lifting thereof, at least one of the lock surfaces (preferably the lock surface 11 on the transfer device 3 with which the roller 13 cooperates) has, in a preferred embodiment, a guide portion 18 extending obliquely to said locking portion 17 and engageable by the wedge 10 (at roller 13) in order to hold the transfer device in an inclined position relative to the hoisting unit 2 (position A, FIG. 3) and through which the wedge may be guided towards the locking portion 17 to a locking position wherein the transfer device is held in a position (position B, FIG. 4) parallel with the hoisting unit. It is hereby possible to lock the transfer device 3 in any required, inclined positioned relative to the hoisting unit 2 for lifting the product 4 without loading its edges (FIG. 3) and locking the transfer device parallel with the hoisting unit after lifting for delivering the product on even ground, whether the ground is horizontal or not, without damaging the edges (FIG. 4). If the ground is not even, i.e. it inclines relative to the vehicle ground, the transfer device is adapted in accordance therewith either by means of the locking device 8 or by inclining the mast 19 of the transport vehicle 1. However, it should be noted once again that substantially all handling of products in the form of paper rolls as here, occurs on substantially even, horizontal grounds.

If necessary, the locking device according to the invention also compensates for "curtseying" of the transport vehicle 1, i.e. that inclined position the vehicle attains during lifting because of the weight of the product to be lifted. This is arrived at, before starting lifting the product 4, by somewhat "lightening" the product and activating the locking device 8 first after said curtseying due to which the vehicle and hoisting unit 2 are inclined relative to the transfer device 3 connected to the product. "Curtseying" may also be corrected by inclining the mast 19 of the vehicle 1. This is suitable if the weight of the product 4 is known and the "lightening maneuver" is not necessary before activating the locking device 8. Instead, locking may occur directly after adaption and connection of the transfer device 3 to the product 4.

In summary, the following happens during a lifting maneuver.

The transport vehicle 1 moves towards the product 4 (FIG. 1). The transfer device 3 automatically adapts to the position of the product 4 and the product is sucked onto the transfer device 3 by means of the suction device (FIG. 2). The product is lifted to some extent in order to observe whether the vehicle 1 "curtseys" or not (FIG. 3). If "curtseying" occurs and/or the product 4 is disposed somewhat inclined relative to the transport vehicle 1, the locking device 8 is activated such that the wedge 10 is brought into engagement with the guide surface 18. The product 4 is lifted with the transfer device 3 locked in an inclined position relative to the hoisting unit 2 (FIG. 3). With the product 4 free from the ground, the locking device 8 is once again activated such that the wedge 10 is brought into locking position against the locking portion 17 of the lock surface 11 (and the transfer device 3) with the product 4 set and locked in parallel with the hoisting unit 2 (FIG. 4). Delivery may now occur on any even ground. Without curtseying and with the product lifted from even ground, said latter locking position is obtained directly and delivery may occur without correction. When delivery is made on uneven ground, the inclination of the transfer device 3 is adapted relative to the position of the product 4 after delivery and/or the mast 19 of the transport vehicle 1 is inclined in relation thereto.

Figure 5:
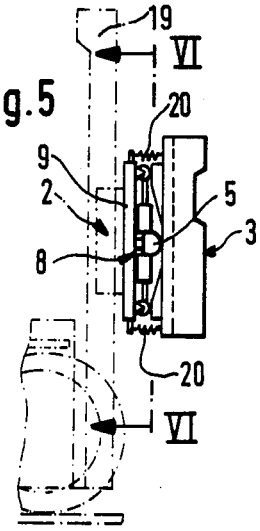
FIGS. 5 and 6 are side and front views respectively of an alternative embodiment of the device according to the invention.
Figure 6:
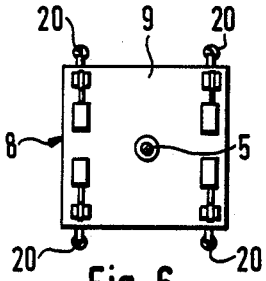

The handling of products in the form of e.g. paper rolls often means that the product must be lifted, transported and delivered in other positions than the above-mentioned lifting, transporting and delivering position, i.e. in other than upright or substantially upright positions. Therefore, the transfer device 3 is also rotatably mounted relative to the hoisting unit 2 such that said transfer device can be rotated from a lifting position about 90° to a position lying down or about 180° to a position upside down. According to the invention, the locking device 8 thereby includes at least one locking unit for locking the transfer device 3 relative to the hoisting unit 2 against forward tilting in lifting position, in a position lying down and in a position upside down. While only one locking unit of defined construction is required for preventing forward tilting of the product 4 in lifting position, two or three lifting aggregates are required to also prevent forward tilting in a position lying down, depending on whether rotation shall occur in both directions from the lifting position, and a further lifting aggregate in order to also prevent forward tilting in a position upside down. A locking device 8 with four locking units is shown in FIGS. 5 and 6. The locking device 8 is here, as previously, provided on the coupling means 9 to a member which preferably also includes a rotating device for rotating the transfer device 3 between defined positions. With this member it is thus possible to fetch products in any position and transport and deliver said products in the same or any other position without the risk of loading or damaging the edged of said products.

Said member preferably also includes springs 20 mounted on the coupling means 9 and connectable to the transfer device 3. These springs 20 form parts of a spring device which is adapted to keep the transfer device 3 set in a neutral position relative to the hoisting unit 2 for preventing forward tilting of the transfer device relative to the member on which it is movably mounted, i.e. here the coupling means 9 but alternatively the hoisting unit, when the transfer device is unloaded (FIG. 1), but which allows adaptation of the transfer device to the product when said transfer device is brought into contact therewith (FIG. 2). Due to the spring device 20, the transfer device 3 thus occupies a position which in most cases permits connection to the product 4 and which prevents shock damage which otherwise may occur during adaption of the transfer device to the product.

It is obvious for a skilled person that besides the abovementioned alternatives and various embodiments, the invention may be modified within the scope of the following claims without departing from the idea and purpose of the invention. Other types of locking devices may thus be used, e.g. link systems or eccentric systems. Conventional guiding cylinders may also be used, which cylinders are provided directly between the transfer device and the hoisting unit or the coupling means and which may be controlled in dependence on the load on the mast (the moment on the mast). Also the spring device may have another construction and another position than shown.

The device according to the invention may advantageously be used for handling other products than paper rolls, e.g. sensitive cardboard boxes, cases, barrels, etc. It is not absolutely necessary to use a transfer device with a suction device for engaging the product, but the suction device may be replaced by closing means of another type, e.g. closing jaws with grip surfaces.

I claim:

1. A device for preventing damage to shock-susceptible products during handling by a vehicle, said vehicle including hoisting means for raising and lowering said shock-susceptible products, comprising:

transfer means attached to said hoisting means for engaging and disengaging said shock-susceptible products; and locking means for maintaining the position of said transfer means relative to said hoisting means to prevent undesired movement of said transfer means during handling, said locking means including first and second locking surfaces, said first locking surface including a relatively inclined portion and a relatively non-inclined portion, and at least one corresponding locking unit comprising means for selectively engaging said relatively inclined portion of said first locking surface when maintaining said transfer means in a first orientation or said relatively noninclined portion of said first locking surface when maintaining said transfer means in a second orientation, wherein said means for engaging said first locking surface engages both said first and second locking surfaces, and wherein said means for engaging said locking surfaces comprises roller means and roller support means, said roller support means arranged to movably engage one of said locking surfaces so that said roller means movably engages said other locking surface.

2. A device for preventing damage to shock-susceptible products as claimed in claim 1, further comprising coupling means arranged to couple said hoisting means to said transfer means during said handling, wherein said coupling means comprises said first locking surface, and said transfer means comprises said second locking surface.

3. A device for preventing damage to shock-susceptible products as claimed in claim 1, wherein said locking unit comprises adjustable means for allowing said surface engaging means to selectively engage said inclined or noninclined portion anywhere along a predetermined distance.

4. A device for preventing damage to shock-susceptible products as claimed in claim 1, further comprising spring means for resiliently fixing the position of said transfer means relative to said hoisting means.

5. A device for preventing damage to shock-susceptible products as claimed in claim 1, comprising universal joint means disposed between said hoisting means and said transfer means, said universal joint means arranged to support said transfer means approximately at its center of gravity for limited rotational movement about said universal joint means.

6. A device for preventing damage to shock-susceptible products as claimed in claim 1, wherein, when said roller means movably engages said other locking surface, at least one locking surface comprises said relatively non-inclined surface.

* * * * *